US005915567A

United States Patent [19]

Zimmermann

[11] Patent Number: 5,915,567

[45] Date of Patent: Jun. 29, 1999

[54] SCREEN ACCESSORY FOR SCREEN AND SCREENING PROCESS

[76] Inventor: Wolfgang Zimmermann, Tulpenstrasse 15, D-83136, Schechan, Germany

[21] Appl. No.: 08/861,767

[22] Filed: May 22, 1997

Related U.S. Application Data

[63] Continuation of application No. 08/495,665, Aug. 3, 1995, abandoned, filed as application No. PCT/EP94/00211, Jan. 26, 1994.

[30] Foreign Application Priority Data

Jan. 28, 1993 [DE] Germany ..... 43 02 360

[51] Int. Cl.[6] ..... B07B 1/52; B07B 1/54

[52] U.S. Cl. ..... 209/389; 209/387; 209/283; 209/358; 209/382

[58] Field of Search ..... 209/283, 324, 209/358, 387, 388, 389, 390, 382

[56] References Cited

U.S. PATENT DOCUMENTS

| | | | |
|---|---|---|---|
| 175,286 | 3/1876 | Hollingsworth | 209/390 X |
| 202,727 | 4/1878 | Herman et al. | 209/324 X |
| 240,163 | 4/1881 | Dorsey et al. | 209/390 |
| 542,093 | 7/1895 | Mowson et al. | 209/390 |
| 630,926 | 8/1899 | Porter et al. | 209/324 X |
| 1,647,696 | 11/1927 | Hermann | 209/390 X |
| 3,252,573 | 5/1966 | Assinck et al. | 209/388 |
| 3,304,064 | 2/1967 | Busam . | |
| 3,863,765 | 2/1975 | Gray | 209/389 X |
| 4,265,151 | 5/1981 | Carruth | 209/616 |
| 4,287,064 | 9/1981 | Ando et al. | 209/388 X |
| 4,650,409 | 3/1987 | Nistri et al. | 209/388 X |
| 4,736,044 | 4/1988 | Ditzenberger . | |

FOREIGN PATENT DOCUMENTS

| | | | |
|---|---|---|---|
| 0 015 633 | 9/1980 | European Pat. Off. . | |
| 111461 | 6/1900 | Germany | 209/324 |
| 1186308 | 1/1965 | Germany | 209/382 |
| 1 266 115 | 4/1968 | Germany . | |
| 1 930 404 | 12/1970 | Germany . | |
| 24 31 267 | 10/1976 | Germany . | |
| 3138430 | 8/1982 | Germany | 209/324 |
| 33 12 365 A1 | 10/1983 | Germany . | |
| 3316222 A1 | 11/1984 | Germany . | |
| 35 04 994 A1 | 8/1986 | Germany . | |
| 87 01 829 | 7/1987 | Germany . | |
| 37 20 490 A1 | 12/1988 | Germany . | |
| 498971 | 4/1976 | U.S.S.R. . | |
| 1544507 | 2/1990 | U.S.S.R. . | |
| 1567285 | 5/1990 | U.S.S.R. . | |
| 1717262 | 3/1992 | U.S.S.R. | 209/388 |
| 21453 | 12/1896 | United Kingdom | 209/390 |
| 518539 | 2/1940 | United Kingdom | 209/390 |
| 1069063 | 5/1967 | United Kingdom . | |
| 1 462 038 | 1/1977 | United Kingdom . | |

*Primary Examiner*—David A. Buccl
*Assistant Examiner*—Thuy V. Tran
*Attorney, Agent, or Firm*—Nixon & Vanderhye

[57] ABSTRACT

The sieve efficiency can be increased in an improved sieve apparatus in such a way tat the sieve apparatus is equipped with a compulsory mixing device (5). By means of this, during the sieve process, the sieve product, which is moving forward along the main flow direction (1) to a delivery end (11), is thoroughly mixed, which produces the desired increase in sieve efficiency.

4 Claims, 3 Drawing Sheets

SCREEN ACCESSORY FOR SCREEN AND SCREENING PROCESS

This is a continuation of application Ser. No. 08/495,665, filed Aug. 3, 1995, now abandoned, which application is a 371 of PCT/EP94/00211 filed Jan. 26, 1994.

BACKGROUND OF THE INVENTION

The invention relates to a sieve apparatus, a supplemental device for a sieve apparatus, as well as a sieve process.

The effectiveness of sieve apparatuses depends upon the movement of the fine-grained portion in the sieve product. It would be ideal if a sieve product feeding gave each undersized particle the possibility of meeting a sieve opening and falling through.

In principle, oscillating sieves are already in use for this reason if no other, an example being linear acting oscillating sieves. By using vibrating or oscillating sieves of this type, the screening or classification of the sieve product, i.e. the sieve process itself, is embodied in a more effective and efficient manner.

British Patent GB-A 1 462 038, which defines the generic type of the invention discloses a vapor extraction apparatus which includes a sieve apparatus disclosed in a closed housing. The mixture of dust and vapor is supplied to this so-called extraction chamber via an inlet flap and is moistened by means of a sprayer device. Via a shaft disposed crosswise to the feed direction, paddles are set into rotation in order to reinforce the flow motion of the sieve product.

German Patent Disclosure DE-B 12 66 115 describes an apparatus for sieving material that contains clumps and lumps. The sieve material is once again fed via a funnel to an inclined sieve. A device for loosening the clumps and lumps is provided above the sieve face in stationary fashion; it includes a substantially vertically oriented shaft, which is drivable via a motor and from which a plurality of protruding bars extend that are seated on it, distributed in the circumferential direction. The pivot axis of the bars is disposed vertically to or inclined relative to the screen lining. In other words, the circular motion of the bars can take place in a circular plane that is parallel to or inclined relative to the sieve lining. These rotating bars are intended to loosen up the mixed scrap appropriately, so as to improve and reinforce the sieveing process.

From the WPI data base, section Ch, week 7642, a sieve apparatus is known which includes two worm extruders extending to a vertically disposed pivot shaft disposed between them. Rotating around the vertical axis are the worm extruders, which advance the sieve material in the radial direction. This involves purely a device for feeding and advancing the sieve product to the edge of the sieve.

A cleaning device for a sieve has been disclosed by British Patent GB-A 1 069 063, It includes metal sheets, formed like an inverted V, which rest with their open side on the top of a sieve in the form of a perforated plate and can be displaced along the sieve by means of chains that are laid on the underside of the V- shaped sheets. This "cleaning effect" is intended to encounter plugging up or stoppage of the sieve holes. In the forward motion of these V-shaped sieve sheets, the sieve product is raised on one ramplike side and deposited again in the direction of the sieve face on the other ramplike side of the sheet.

SUMMARY OF THE INVENTION

By comparison, the object of the present invention is to create an improved sieve apparatus and a supplementary device to increase the sieve efficiency, as well as an improved process for sieving, which should improve efficiency and effectiveness during sieving.

In contrast to conventional sieves, the present invention achieves a possibility of actually distinctly improving the thorough mixing of the product during the sieve process, which—as has been shown—is actually the essential premise of it, that the sieve efficiency can be distinctly increased once more compared to conventional embodiments.

As is known, the grain layer commonly bounces on the particularly vibrating sieve without achieving a thorough mixing of any consequence. With soft and plastic material, a densification of the product can in fact also occur due to the up and down motion of an oscillating sieve, which severely impairs the thorough mixing. Product moisture can likewise lead to a decline in sieve efficiency. Despite such sieve aids as elastic balls, which strike the underside of the sieve, it cannot achieve an effective improvement of the sieve efficiency. Right in the latter example in fact, the opposite effect occurs, that as a result can lead even sooner to a clogging of the sieve opening.

So lastly, there is an economical loss by means of the incomplete separation of the undersized particles.

This can be effectively counteracted with the present invention.

According to the invention, a distinct improvement, which as a result is really amazing to describe, of the sieve efficiency (from for example 90% in conventional sieves up to 98% according to the invention) is realized solely by the fact that a compulsory mixing is provided for the sieve product. This optimal compulsory mixing is achieved by moving the mixer shaft along the sieve and having the mixing mechanisms engage progressive points of the sieve material. In other words, as a result of this compulsory mixing the sieve product is optimally mixed thoroughly, so that the proportion of the fine particles in the immediate vicinity of the sieve opening can be further increased, and the sieve efficiency thereby improved. Mixing or compulsory mixing means among other things that during the sieve process in at least one location or preferably a plurality of locations, the sieve product is moved and thoroughly mixed section by section again and again, and if need be, also with a different movement component and/or different intensity. In other words, that is, during the mixing process, the most various regions of the mg product are circulated, at least in some regions and/or also intermittently, with a movement component in the lateral direction of the main flow direction, if need be also with a component in the reverse flow direction, with a movement component directed upward, that is, extending up away from the sieve face, or with a component directed downward, that is, extending toward the sieve face, and in this way at last thoroughly mixed independent of—or essentially independent of—the main flow direction.

In a preferred embodiment of the invention, the arrangement can be such that the rotating mixing mechanisms, during their revolving motion, "knock" in response to the up- or down-motion of the sieve. As a result of this knocking and the thus—compelled downward deflection motion of the sieve, the particles (so-called fish) located in the sieve mesh are loosened and are removed from the sieve openings by means of their inertia.

In a further preferred embodiment of the invention, also with oscillating sieves, the mixer or compulsory mixer (with its shaft) can be installed parallel to the main direction of feeding of the sieve product, which mixer is then moved by a suitable apparatus back or forth over the width of the sieve, or is processed; the mixer shaft turns at a suitable speed and possibly changes directions. Once again, the orientation of the mixer shaft may also be crosswise to the main flow direction, in which case the mixer shaft is moved back and forth preferably along the main flow direction.

In an alternative embodiment, the sieve apparatus, which in particular is equipped with an oscillating sieve, can be outfitted with one or a plurality of circular mixers, which preferably have plow mixing mechanisms. Circular mixers of this kind can also be used in round sieves.

In oscillating sieves, such as brush rollers, which are installed crosswise or parallel to the main conveyor device and which move back and forth, or also compulsory mixers, can loosen and mix the sieve product and at the same time keep the sieve openings clear. In round sieves, the same effect can be achieved by revolving brush rollers or compulsory mixers.

It is noted only for the sake of completeness that the sieve face can also remain fundamentally unmoved; the transport of the sieve product over the sieve face is carried out or supported by correspondingly embodied compulsory mixers. In that case, the sieve face is preferably slanted.

BRIEF DESCRIPTION OF THE DRAWINGS

The invention is further explained below from the exemplary embodiments. In particular.

DETAILED DESCRIPTION OF PREFERRED EMBODIMENTS

Figure 1:
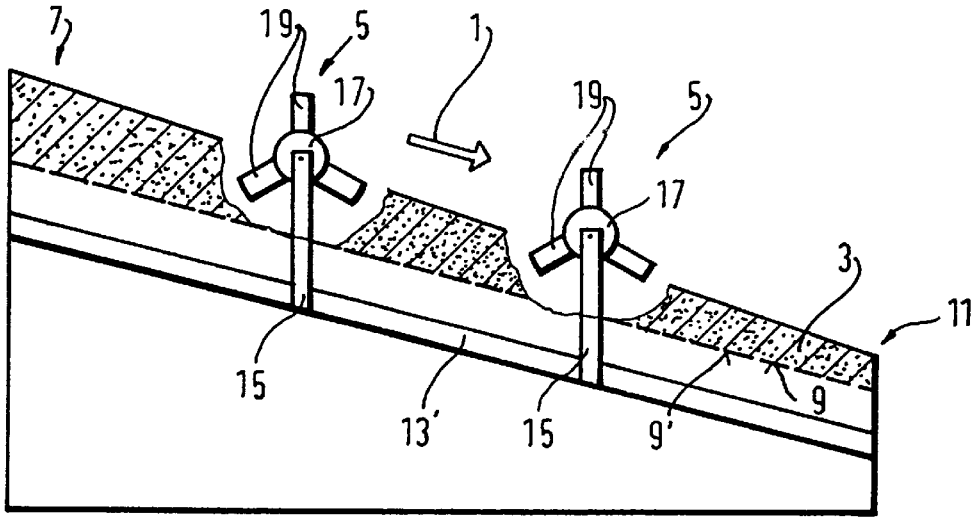
FIG. 1 shows a side view of an oscillating sieve.
Figure 2:
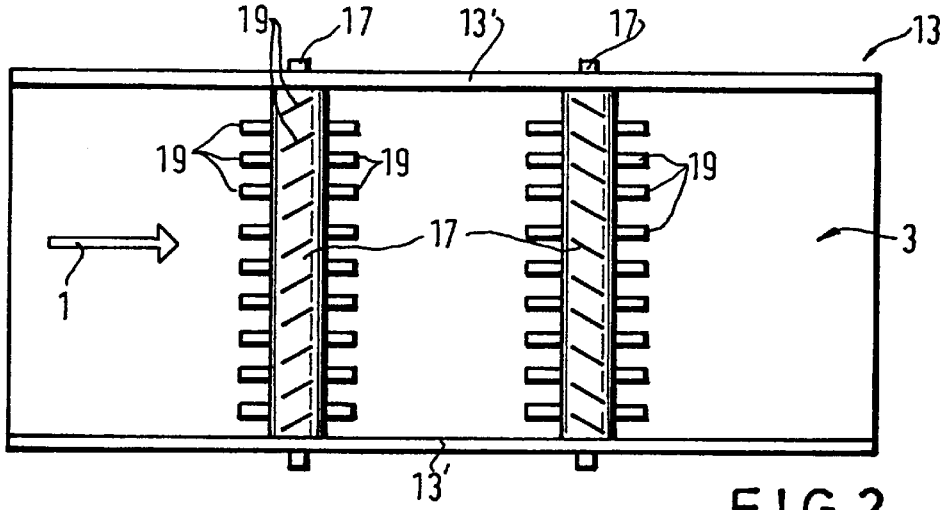
FIG. 2 shows a top view of the oscillating sieve shown in FIG. 1.

FIG. 1 shows a side view of a first exemplary embodiment and FIG. 2 shows a top view of a schematic reproduction of a sieve apparatus with two mixing devices 5 disposed offset in the main flow direction 1 of the sieve product 3, which devices can be moved back and forth parallel to the main flow direction by a device not shown in detail here.

The sieve product 3 is moved from a supply end 7 via the sieve 9, e.g. the sieve face 9', to a delivery end 11. Et preferably concerns an oscillating sieve, preferably a sieve provided with a linear oscillation exciter, also called a vibrating or shaking sieve. As shown in FIG. 1, the sieve, from its supply end 7 to its delivery end 11, can extend sloped at an angle of for example greater than 3° and preferably less than 25° or 15°.

In the exemplary embodiment shown, a shaft or mixer shaft 17 is disposed laterally extending on the frame 13 of the sieve apparatus, that is, on the side frame 13', on lateral pillars or carriers 15, which shaft extends horizontally at an even spacing, crosswise, that is obliquely or vertically, to the main feeding direction or longitudinal direction 1 of the sieve. The motor drive device is not shown further. The mixer shafts 17 shown in FIGS. 1 and 2 are also movable along the sieve face, specifically in the main flow direction 1 and back. The displacement mechanism is not shown.

Radially protruding mixing mechanisms 19 are embodied on the shaft 17, which are disposed offset to the shaft in the longitudinal direction. In the exemplary embodiment shown, the mixing mechanisms 19 are disposed in three rows, offset circumferentially, in discrete steps extending over the longitudinal direction of the shaft 17. The individual mixing mechanisms 19, which are in the shape of blades, plates, shovels, metal sheets or sheet metal strips, paddles, or plowshares, or other shapes, are provided in the exemplary embodiment shown, which, upon rotation of the shaft in the depiction according to FIG. 1, rotate and are driven clockwise or counterclockwise, or with changing rotation direction. On its path along the main flow direction 1, when the sieve product passes the relevant mixing device 5, the sieve product is not only loosened in regions and sections by the mixing mechanisms 19 mentioned, but primarily re-layered, i.e. thoroughly mixed. In this mixing process, i.e. compulsory mixing process, the corresponding regions of the sieve product 3 are re-layered and thoroughly mixed with a variable moving and mixing component in a way that diverges from the main flow direction 1, for example sloped toward the front, sloped toward the back, or in a perpendicular crosswise direction, or in a reverse-directed direction, that is, generally in a direction superimposed on the direction of the sieve product longitudinally or crosswise. In thorough mixing, there are also moving components, which are directed upward from below, i.e. directed away from the sieve face 9', but also ones which are directed toward the sieve face 9'. By means of this compulsory mixing, at any rate, the fine-grained percentage in the immediate vicinity of the sieve 9 increases, which increases sieve efficiency.

Since the mixing mechanisms are disposed in discrete steps on the relevant mixer shaft or the mixing mechanism carrier, there are also always passageways through the mixing mechanisms when thoroughly mixing, which intensify the mixing effect. In other words, that is, in a plurality of locations, different sections of the at least one mixing mechanism, or in accordance with the exemplary embodiments shown, the plurality of for example shovel- or plow-like mixing mechanisms, dip into the sieve product to be thoroughly mixed; by means of these mixing mechanisms and the various movement speeds and if need be rotation speeds of the mixing mechanisms, the sieve product is optimally, thoroughly mixed and re-layered andthe sieve product can pass through between two neighboring mixing mechanisms upon further drive motion of the mixing mechanisms. As a result, there is a kind of "rake or plowshare effect". By means of this intermittent disposition of the mixing mechanisms or their being disposed laterally offset to one another, it is additionally guaranteed that fundamentally by means of the mixing mechanisms themselves, the infeed motion of the sieve product as a whole toward its delivery end is further possible in principle and is not dammed by the mixing mechanisms themselves as would happen with a gate and barrier.

The radial length of the mixing mechanisms can be calculated in such a way that when rotating, the front, radial ends of the mixing mechanisms touch the sieve face 9', i.e. knock against the sieve face 9', and abruptly, with at least minor speed, buckle it or bend it downward at least for a short time; by means of this abrupt knocking, the particles, which are closing the mesh openings are accelerated upward, out of their mesh openings due to their inertia.

Figure 3:
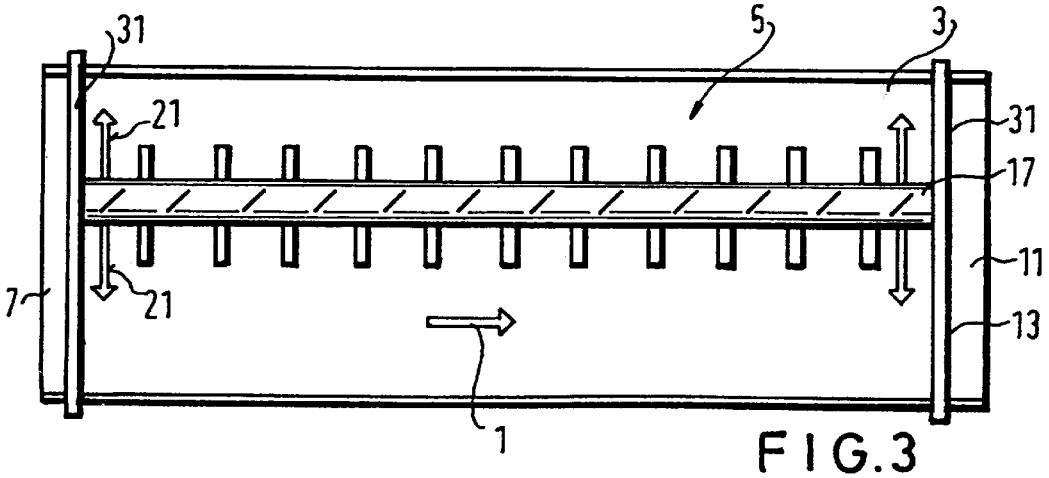
FIG. 3 shows a top view of an oscillating sieve in an exemplary embodiment modified from FIGS. 1 and 2.

In the embodiment form according to FIG. 3, only one mixing device 5 is provided, whose shaft 17, deviating from FIGS. 1 and 2, is provided extending in the longitudinal direction of the sieve, i.e. toward the main flow direction 1; on the opposite face ends in the region of the supply end 7 and the delivery end 11, the shaft 17 is suspended so that it can travel laterally on a bridge, which extends above the sieve 9 and the sieve product 3. In other words, the mixing device 5 travels crosswise to the main flow direction 1, from the left to the right edge of the sieve 9 and vice versa as indicated by the arrows 21, in order to optimally re-layer and thoroughly mix the sieve product section by section, again and again during its forward movement along the main flow direction 1 by means of the mixing mechanisms 19.

Figure 4:
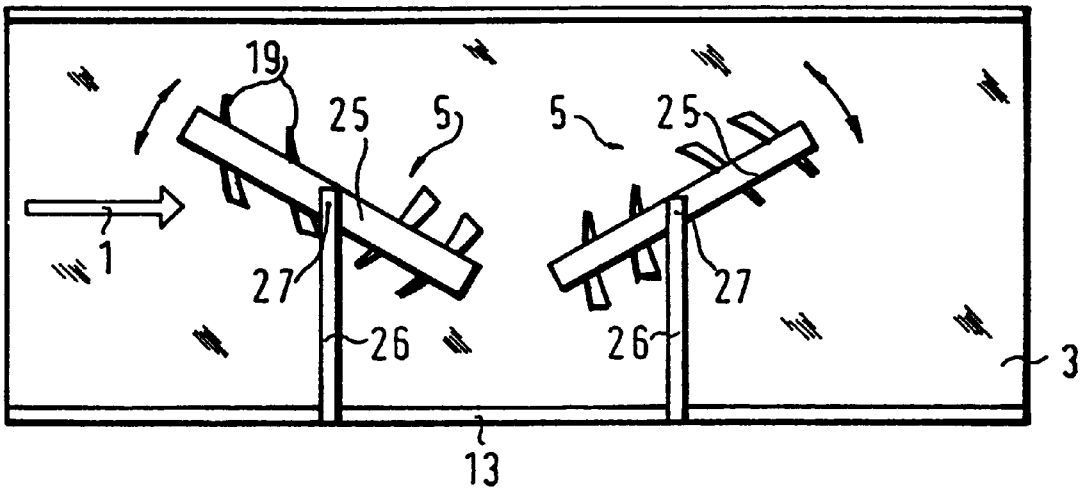
FIG. 4 shows a top view of a further exemplary embodiment of a sieve apparatus according to the invention, having revolving mixer bars with plowshare mixers.
Figure 5:
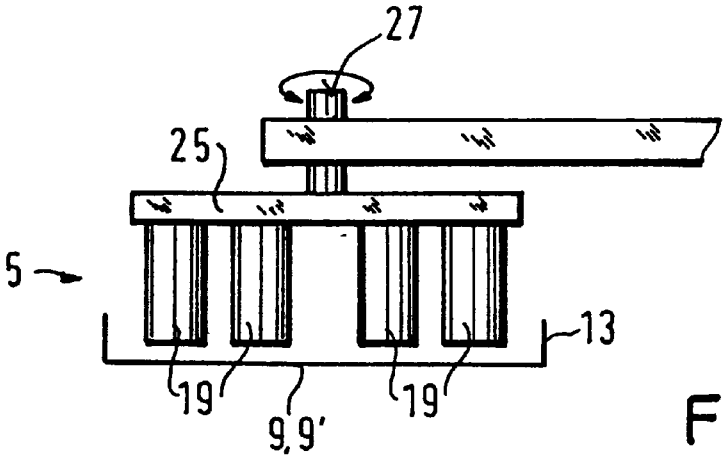
FIG. 5 shows a side view of a revolving mixer bar above the sieve, which bar is shown in FIG. 4, FIG. 6 schematically represents a vertical section through a round sieve.

In the depiction according to FIGS. 4 and 5, a rotating mixer bar 25 is shown, which is disposed above the sieve face 9' offset in the main flow direction 1 and which is rotatably suspended on a horizontal carrier 26, which is connected respectively to the frame 13, on the longitudinal direction of which mixing bar 25 are affixed downward-protruding mixing mechanisms 19 in the shape of plates, shovels, etc. and which are disposed offset from each other. The mixer bar 25 rotates around a vertical axis 27—i.e. generally around an axis 27 which is perpendicular to the sieve face 9'. The drive mechanisms for this are not shown.

Once again, the sieve product is correspondingly, sufficiently re-layered, loosened, i.e. completely, thoroughly mixed with a wide range of movement components, by shovel- or plate-shaped mixing mechanisms 19, which also, in the depiction according to FIG. 4, in particular are aligned obliquely with regard to the longitudinal direction of the mixing bar 25 and extend if need be symmetrically to the middle mixing axis 27.

As a rule, it is sufficient if the radially protruding ends of the mixing mechanisms 19 do not touch the actual sieve 9, but pass by above the sieve face 9', spaced apart from it by a preferably small distance during the rotation movement. The spacing can be varied and optimized as required according to the type of sieve product to be sieved. Spacings of around 1 cm are completely sufficient. The action is improved—as explained—if during rotation, the radial ends of the mixing mechanisms, at least for a short time, knock into the sieve surface from above, pressing through so that after the sieve face oscillates back into the initial position, the particles situated in the sieve openings can be accelerated out of them.

In FIGS. 1–3 it is shown that the different rows with the mixing mechanisms 19 actually equidistantly spaced, which rows are offset circumferentially by for example 90° or 120°, can be aligned disposed in individual rows, but offset from each other. Just as well, the mixing mechanisms can be provided disposed in the same position in the longitudinal direction of the relevant shaft 17, merely offset in the circumferential direction.

Figure 6:
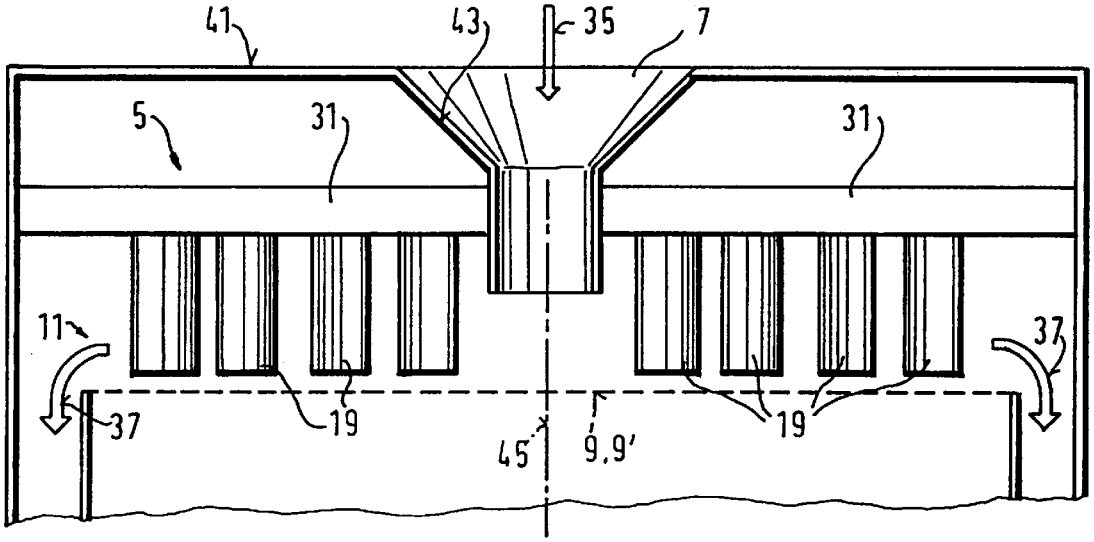
Figure 7:
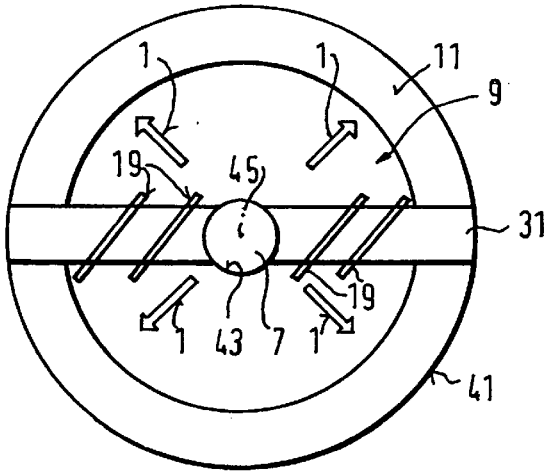
FIG. 7 schematically represents a top view of the exemplary embodiment according to FIG. 4.

FIGS. 6 and 7, in schematic vertical cross section and in a top view, respectively, show a sieve apparatus with a round, i.e. circular sieve face 9', which diverges from the above explained rectangular sieve faces 9'.

In these cases, the sieve product to be sieved is supplied along the arrow 35 to a funnel-shaped supply end 7, which is disposed above the circular sieve 9 and in the middle of it. In this embodiment form, the delivery end 11 for the sieve product is constituted by the circular circumference, i.e. the outer limit of the sieve 9. There, the portion of the sieve product, which is not sieved through the sieve opening, can flow away along the arrows 37 toward the outside into a separate chamber, which is not shown.

The entire sieve apparatus, with the funnel-shaped supply end 7 that is acessible from above, can be covered by a cover 41, which for example rotates together with the funnel-shaped supply end 7 and the mixing device 5 accommodated in it. In the exemplary embodiment shown, two fastening bridges 31 are provided there for the mixing device 5, which am internally, radially connected to the funnel 43, which constitutes the supply end 7, and are connected on their radial, outer ends to the cover 41, and rotate together with this around a vertical, central axis 45. Suitably shaped mixing mechanisms 19 protrude downward on the fastening bridges 31, which mechanisms can end for example just above the sieve face 9'. The mixing mechanism rotates around the vertical rotation and symmetry axis 45; the sieve product is continually re-layered and optimally mixed thoroughly during its wandering movement from the middle to the outer circumference (delivery end 11), that is, along its main flow direction 1, which extends radially outward from the middle, by means of the rotation of the mixing device, wherein the sieve effect is improved.

The so-called horizontal and radially extending fastening bridges form the rotating shafts 17, so that a superimposed rotary motion occurs once around a vertical symmetry axis, perpendicular to the sieve face 9', and also around the radially extending mixing mechanism carrying arms, that is, the mixer shaft 17, which carry the mixing mechanisms 19. In the latter case, the lower ends of the mixing mechanisms 19 once again "knock into" the sieve surface in order to counteract possible stoppages. The first and second rotary axes for the bridges 31 of the mixer shaft are in the directions indicated by the arrows A and B, respectively, in FIG. 6. A motor M is suitably connected to the cover 41 and the bridges 31 through gearing, not shown, to rotate the cover 41 and bridges 31 about respective axes.

In the latter exemplary embodiment according to FIGS. 6 and 7, as a rule a vibrating or shaking sieve (oscillating sieve) is also employed; here in particular a circular oscillation or vibration can be produced, via which the mixing product drifts along the main flow direction 1 from its central supply end 7 radially outward, as the sieve product height becomes increasingly less.

I claim:

1. A sieve apparatus, comprising:

a sieve having a sieve face for sieving material including fine material;

means for mixing the material on said sieve to increase the proportion of fine material passing through the sieve including a rotational device having a rotatable mixer shaft with members extending towards said sieve face and into material to be mixed, said rotatable mixer shaft being movable back and forth across said sieve during mixing of said material, said rotational device, during rotation, contacting said sieve face and deflecting said sieve face at least slightly downwardly and, after said contact, said sieve face returns automatically to its non-deflected configuration.

2. The sieve apparatus according to claim 1, and including at least two rotatable mixer shafts.

3. The sieve apparatus according to claim 1, wherein said mixing members are in the shape of blades.

4. The sieve apparatus according to claim 1, and including an oscillating device for oscillating or vibrating said sieve.

* * * * *